US008376345B1

(12) United States Patent
Haydt, III et al.

(10) Patent No.: US 8,376,345 B1
(45) Date of Patent: Feb. 19, 2013

(54) CUTTER DEVICE FOR USE WITH MAILING MACHINE

(75) Inventors: Leo A. Haydt, III, Palmerton, PA (US); Christopher Segatti, Pen Argyl, PA (US)

(73) Assignee: Sensible Technologies, L.L.C., Austin, TX (US)

( * ) Notice: Subject to any disclaimer, the term of this patent is extended or adjusted under 35 U.S.C. 154(b) by 0 days.

(21) Appl. No.: 12/947,733

(22) Filed: Nov. 16, 2010

Related U.S. Application Data

(60) Provisional application No. 61/261,704, filed on Nov. 16, 2009.

(51) Int. Cl.
*B65H 39/00* (2006.01)

(52) U.S. Cl. ..... 270/52.17; 270/21.1; 270/58.07

(58) Field of Classification Search ..... 270/21.1, 270/37, 45, 58.06, 58.07, 58.08, 52.17
See application file for complete search history.

(56) References Cited

U.S. PATENT DOCUMENTS

| | | | | |
|---|---|---|---|---|
| 3,165,954 | A | 1/1965 | Huck | |
| 4,076,231 | A | 2/1978 | Kutzner et al. | |
| 4,166,613 | A * | 9/1979 | Kort et al. | 493/342 |
| 4,511,131 | A | 4/1985 | Raybuck | |
| 5,033,727 | A | 7/1991 | Szewczyk et al. | |
| 5,100,118 | A | 3/1992 | Hobbs et al. | |
| 5,158,273 | A | 10/1992 | Wagner | |
| 5,197,262 | A | 3/1993 | Katz et al. | |
| 5,288,063 | A | 2/1994 | Lunt | |
| 5,777,443 | A | 7/1998 | Chang | |
| 5,810,346 | A * | 9/1998 | Jorg | 270/59 |
| 6,402,132 | B1 * | 6/2002 | Michaelis et al. | 270/1.01 |
| 6,910,686 | B2 | 6/2005 | Awano | |
| 7,328,893 | B2 | 2/2008 | Kawatsu et al. | |
| 7,506,864 | B2 | 3/2009 | Wakabayashi et al. | |
| 7,865,304 | B2 * | 1/2011 | Gretton et al. | 701/418 |

* cited by examiner

*Primary Examiner* — Leslie A Nicholson, III
(74) *Attorney, Agent, or Firm* — Chamberlain Hrdlicka

(57) ABSTRACT

A cutter device for removing the spine from packets of sheet materials to be enveloped by a mailing machine, including means for redirecting the packets across said cutter device while the packets remain superimposed with other sheet materials to be inserted into the same envelope while being moved along a support surface by a conveyor mechanism, and after cutting being recombined with said other sheet materials prior to being enveloped.

9 Claims, 4 Drawing Sheets

CUTTER DEVICE FOR USE WITH MAILING MACHINE

CROSS REFERENCE TO RELATED APPLICATION

This patent application is a non-provisional of and claims the benefit of Provisional Application No. 61/261/704 filed on Nov. 16, 2010, which provisional application is hereby incorporated by reference in its entirety for all purposes.

BACKGROUND OF THE INVENTION

1. Field of the Invention

The present invention generally relates to machines for collating individual sheets of paper from a plurality of stacks to form packets which are inserted into envelopes for mailing, and more particularly to a cutter device for use in combination with said collating machines for trimming or removing the folded edge or spine of a plurality of sheet materials provided in booklet form in one or more supply stations, which sheets are collated with the individual sheets from other supply stations, and more particularly still to a cutter device that be positioned for use with any supply station in a row of such stations, and whereby only those sheets needing to be cut or trimmed are passed through the cutter device.

2. Description of Related Art

Numerous mechanical devices for automating the process of stuffing or inserting sheet materials such as mail, flyers and advertising sheets into envelopes are known and available in the prior art. Where a plurality of sheets is to be inserted into a single envelope, stacks of each of the individual sheets are normally placed in pockets at picking or supply stations spaced apart along a support railing including a continuous conveyor belt or track. Pairs of upstanding separator bars or fingers are provided on the track, dividing the track into a plurality of sheet material receiving sections each for collecting piles of the individual sheets from each supply stations to be enveloped, enabling the coordinated sheet collection and collating process to be continuous. A first sheet from the stack of such first sheets in the first supply station is removed from the stack by a grasping mechanism which places the sheet in a track receiving section situated directly in front of the first supply station. A pair of guide angles is provided on either side of the track to further support the sheets on the track. The sorting machine is then operated to move the track so the first sheet is pushed or moved from a position adjacent the first supply station to a position adjacent a second supply station, where a sheet from the second supply station is placed on top of the first sheet by a grasping mechanism. At the same time, another sheet from the first station is placed on the track in the receiving section adjacent the initial pile. This process continues until sheets from each station or pocket have been placed on top of the pile of previously dispensed materials, forming the stack of sheet material to be enveloped. In parallel with the movement of sheet material along the track, typically there is another station filled with envelopes, whereby an envelope is pulled from the envelope station and moved parallel to the movement of each stack or pile of sheet material. The flap of the envelope is opened and is moved to an insert station, where the stack of sheet material is pushed into the envelope. The envelope then is moved from the insert station, and the envelope flap is sealed and closed.

A shortcoming of such mechanical mailing machines is that there are physical limitations, at least in practical terms, in the number of individual supply stations that can be arranged side by side in a row along the length of a conveyor system, thus limiting the number of individual sheets that can be added to a packet. One solution is to place folded packets containing a plurality of different advertising sheets joined along a common margin or seem in one or more of the supply stations. However, prior to the packets being inserted into an envelope, the folded edges or spines of the packets are preferably removed by cutting or trimming, separating the folded material into individual sheets. In addition, to prevent damage to the individual sheets picked at the other stations, only the folded packets should be passed through the cutting device.

U.S. Pat. No. 5,033,727 issued to Szewczyk et al. addresses this problem by providing a cutter device for use with an inserter machine which is designed to cut or trim the backbone of such packets to disassemble the packets into individual sheets. However, a significant shortcoming of the Szewczyk et al. cutter device is that it can only be used with supply stations which are positioned upstream from supply stations containing individual sheets, in order to prevent the individual sheets from also being passed through the cutter device or chopper and becoming stuck or damaged. Thus, in the Szewczyk et al. cutter device can only be used with the first supply station in a line, and while the ability to load a supply station with folded packets enables a greater number of advertising sheets to be collated for insertion into an envelope, the operator's ability to position the supply station containing folded packets along the conveyor means is limited. Such prior art enveloping process while comprising an improvement in the art is nevertheless still inflexible, and the operator's ability to arranged the stacked sheets in a desired order, or to change the order of on the fly, remains limited. In today's fast paced society, where advertising campaigns are continually implemented and revised, and orders are placed up to the last minute, maximum flexibility in processing such orders is critical. For example, a certain advertiser might be willing to pay an increased fee for their advertisement to be positioned as the first sheet in the stack of inserts. However, if the folded packets have already been formed, in prior art collating arrangements it would not be possible to change the order since the folded packets must be in the first supply station.

While the prior art mailing machines and associated cutter devices available in the prior art are useful for their own particular purposes, the present inventors have recognized the need for a cutter device having more flexible use parameters, whereby the cutter device can be used to cut off the folded edge or spine of folded packets of sheet material to separate the folded packets into individual sheets with any supply or picking station situated in a row of such stations coordinated with a mailing machine conveyor track, without cutting any individual sheets dispensed from supply stations upstream from said cutter device. In such invention, only the folded packets are passed through the cutter device, while individual sheets or previously cut packets bypass such cutter. Thus, using the present inventors cutting device and system, supply stations containing folded packets having a bound edge can be intermixed with supply stations containing individual sheets, without having to worry that the individual sheets will be damaged by the cutter. In addition, the inventors have surprisingly conceived of a unique cutting wheel or blade design that minimizes tearing of the packets during such high speed cutting processes.

OBJECTS OF THE INVENTION

It is therefore a primary object of the present invention to provide a cutter device to be used to remove the folded edge or spine of packets of sheet material to separate the folded packets into individual sheets.

It is a further object of the present invention to provide an insert cutter device for use in combination with a mail insert machine to remove the folded edges or spine from folded packets of sheet material dispensed from a supply station.

It is a further object of the present invention to provide an insert cutter device for use in combination with a mail insert machine to remove the folded edges or spine from folded packets of sheet material dispensed from one or more sheet material supply stations that does not cut or damage individual sheets picked from other supply stations upstream from such supply station.

It is a still further object of the present invention to provide a cutter device for use with a mailing machine to remove the backbone or spine of folded packets of sheet material, which cutter device can be retrofitted for use with supply stations located at any position along the mailing machine conveyor track or line.

It is a still further object of the present invention to provide a cutter device for use with a mailing machine to cut the folded edge or spine from folded packets of sheet material without cutting any already collated individual sheets, wherein multiple cutter devices may be operated simultaneously on the same mailing machine line at different supply stations intermixed with supply stations dispensing individual sheets.

It is a still further object of the invention to provide an improved rotary cutting blade or knife for use in cutting off or removing the folded edge or spine from folded packets of sheet material to separate the packets into individual sheets.

Still other objects and advantages of the invention will become clear upon review of the following detailed description in conjunction with the appended drawings.

SUMMARY OF THE INVENTION

A cutter device for use in combination with a mail inserter machine is provided, which device allows packets of materials each comprised of a plurality of connected films or sheets to be stacked in one or more sheet material supply stations to be added to an insert packet. The cutter device is utilized to cut or remove the spine of the bound packets prior to being enveloped. Rather than being placed directly on top of any individual sheets collected from previous supply stations, the packets are picked and placed on a pair of auxiliary support angles and directed across the blade of the cutter device to remove the spine, disassembling the packets into a plurality of individual sheets which are then upon being moved to the next station of the mailing machine added to the pile of individual sheets. Such arrangement enables the supply stations containing packets of materials to be placed at any position in the line of supply stations coordinated with the mailing machine, not only increasing the number of materials that can be added to an insert package without increasing the number of supply stations, but also improving the versatility of the machine as there are fewer restrictions as to the order of the pages in the final insert materials. Also provided is a special cutting blade having precise dimensions and a plurality of notches spaced apart along the cutting edge of the blade, which blade it has been found provides better cutting results without binding of the paper material in combination with a stationary anvil. The cutter device may also be used or adjusted and retrofitted for use with various types of mail inserter machines and picking mechanisms where it is desired to cut some but not all of the accumulated sheets or films in a stack of such sheets or films moved along a stepped pathway.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
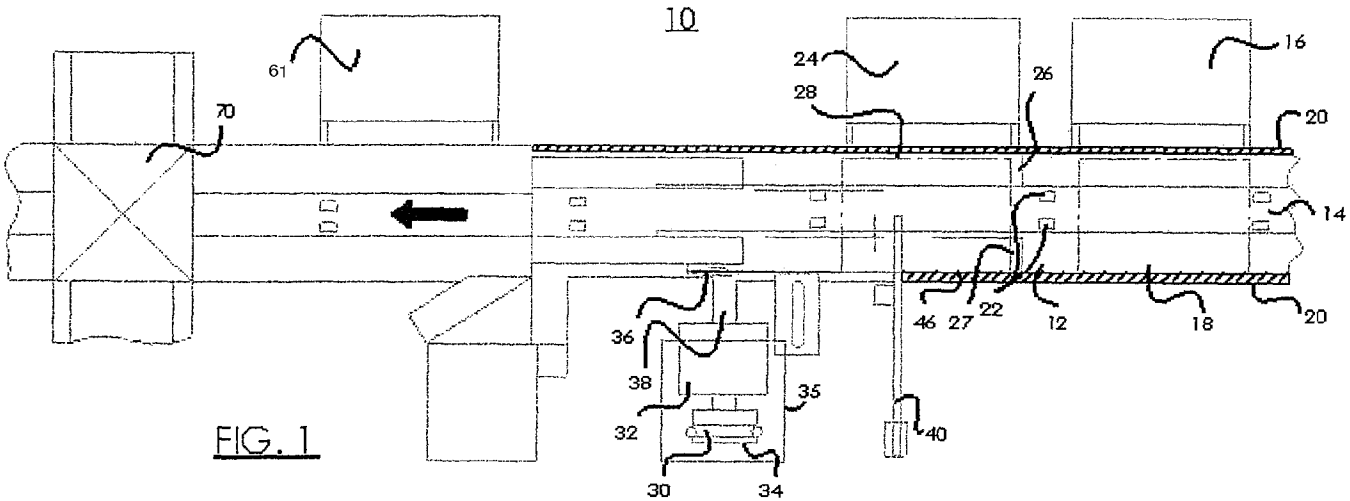
FIG. 1 is a schematic top plan view of a mailing machine setup incorporating the cutter device of the present invention.

The present invention is directed to a cutter device for use in combination with a mail inserter machine, for the purpose of cutting off the bound edges or spine of packets of sheet materials prior to being inserted into an envelope. A main advantage of the present inventors cutter device is that multiple devices can be coordinated for use with any of the sheet material supply or picking stations of the mail inserter machine, regardless of whether or not they are upstream or downstream from other supply stations where individual or single sheets, or any packets that have already had their bound edge removed. Use of the present inventors' cutter device greatly increases the number of individual sheets that can be stacked for insertion into an envelope without having to increase the number of picking stations, and in addition improves the operator's management capabilities by allowing the order and arrangement of the sheets to be much more easily revised in order to fulfill advertiser or customer requirements. FIG. 1 illustrates a typical mailing machine setup 10 having a plurality of sheet material supply stations arranged in a row adjacent and partially overlying a conveyor means, of a type with which the cutter device 30 of the present invention in a preferred embodiment is designed to be utilized to cut off or remove the folded edges or spine from folded packets of sheet material when picked from a supply station prior to being enveloped by mailing machine 10. Mailing machine 10 includes a frame which supports an elongated support rail 12 on which a continuous conveyor belt or track 14 is supported, as well as the majority of the other components of the system described herein. Mounted near one end of support rail 12 is a first sheet material supply station 16, in which a supply of single or individual sheets or pages 18 is stored. A picking mechanism, not shown, operation of which is controlled by a machine control system, is used to individually dispense sheets 18 from supply station 16 onto support rail 12, where the sheets are rested on and situated between pair of angles 20 (as shown in dotted lines in FIG. 1). It will be understood that the present inventors cutting device can be utilized with mailing machines having various types of picking mechanisms which are utilized to grasp a sheet of material such as a paper insert from a picking station containing a stack of such sheets, and transfer the sheet to a conveyor means for creating a pack of such sheets to be enveloped.

Movement of track 14 is controlled by the mailing inserter machine 10 control system, and in the presently described arrangement is adapted to rotate discontinuously in the direction of arrow 19 on track 14. Upstanding separator bars 22 secured to track 14 in a spaced-apart fashion divide the track into a plurality of individual sections each generally sized to receive the sheet material to be collated and enveloped by mailing machine 10. As track 14 rotates in the direction of arrow 19, sheet 18 which was placed on track 14 by the picking mechanism associated with supply station 16 is moved along track 14, stopping in front of the next sheet material supply station 24. As should be readily understood by those skilled in the art, track 14 of mailing machine 10 is set to move at repeating discontinuous intervals a predetermined distance such that the sheet material placed on track 14 at a previous supply station is now moved so to a positioned directly adjacent the next supply station, whereby the sheet material in such next supply station is dispensed and placed on top of the sheet materials dispensed at the previous stations. As shown in FIG. 1, exemplary mailing machine 10 includes a second sheet material supply station 24 situated next to and downstream in relation to the movement of track 14 from first sheet material supply station 16. However, as will now be explained, second supply station 24 has been adapted to dispense folded packets of sheet material, which packets are passed through cutter device 30 to remove the folded edge or spine of such sheet materials to separate them into individual sheets prior to being physically stacked on top of sheet 18.

A pair of forward and rearward horizontal upper guide angles 26 and 27 are secured to support rail 12 in front of second supply station 24 extending above the level of track 14 and horizontal sections of angles 20. Thus, when a sheet material packet 28, shown in dotted lines, is dispensed from second supply station 24 by the picking mechanism associated with such station, the picking mechanism will place the packet on upper guide angles 26 and 27, not angles 20. Meanwhile, single sheet 18 which as indicated above has been moved along track 14 on angles 20 to a position in front of second supply station 24, is passed underneath guide angles 26 and 27, such that sheet 18 is supported on angles 20 and sheet material packet 28 is supported on angles 26 and 27, with packet 28 being essentially superimposed on top of sheet 18. Sheet 18 and packet 28 will also be situated between the same pairs of separator bars 22, which extend upwardly between angles 26 and 27 a sufficient distance so that sheet 18 and packet 28 will be contacted on its side edge by separator bars 22 and moved down track 14 by such bars simultaneously with sheet 18, even though they are supported on different sets of angles.

Figure 3:
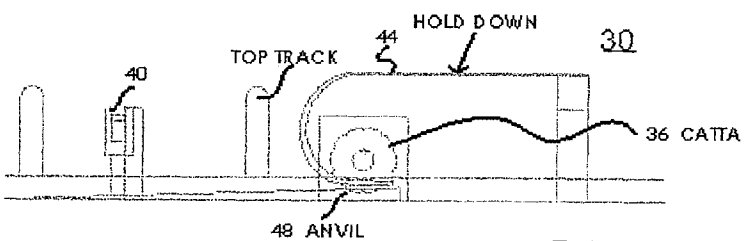
FIG. 3 is a schematic second side view of the cutter device of the present invention.
Figure 2:
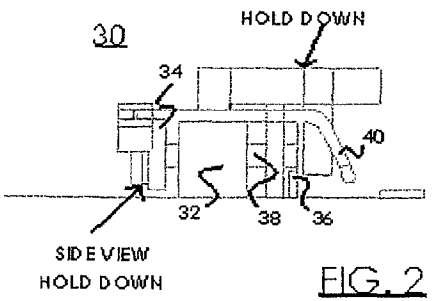
FIG. 2 is a schematic first side view of the cutter device of the present invention.

Provision of angles 26 and 27 on which folded packet 28 is supported allows packet 28 to be redirected to cutter device 30 where the folded edge or spine of the packet can be cut off, while individual sheet 18 is not passed through the cutter device. Referring also now to FIGS. 2 and 3, where additional features of the cutter device 30 of the invention is shown, said device 30 includes a bearing block and mount 32, and a motor drive 34 both of which are provided in housing 35 (see FIG. 1). Cutting blade 36 is secured to the end of drive shaft 38 and is positioned facing inwardly towards track 14. A pivoting spring-activated hold-down bar 40 is positioned on the upstream side of motor housing 35, and across from second supply station 24. In addition, another hold-down or guide 44 is mounted extending downwardly in close proximity to top surface of upper angles 26, which aids in holding folded packet 28 in proper position as it is passed across cutting blade 36.

Upon each folded packet 28 being dispensed from second supply station 24, the folded edge or spine 46 of packet 28 is positioned or aligned against upper angle 27, and the lower edge of hold down bar 40 is moved downwardly against the upwardly facing surface of packet 28 to hold it in place and prevent the pages from flipping open while being guided to cutter device 30. As packet 28 is then moved forwardly on track 14, folded edge or spine 46 is directed into the path of cutting blade 36, where it will be cut off by such blade, while sheet 18 is simultaneously moved on track 14 underneath angles 26 and 27 and therefore is not directed into the path of cutting blade 36. More particularly, as is best shown in FIG. 2, a small space 41 is provided between the horizontal edge of upper angle 27 and the cutting edge of blade 36. In addition, as best shown in FIG. 3, as folded packet 28 is moved towards blade 36 by movement of track 14 in the direction of arrow 19, its folded edge or spine 46 will be directed upwardly toward blade 36 by stationary anvil 48. When blade 36 contacts the folded edge or spine 46 of packet 28, the packet 28 is pressed against anvil 48 and the outer surface of angle 27, so that the blade 36 cuts packet 28 slightly inwardly of folded edge or spine 46, thereby cutting off such folded edge or spine 46 and separating packet 28 into a plurality of separate or individual sheets. Guide 44 is also pressing against the upwardly facing surface of packet 28 to further ensure that the packet remains properly aligned with blade 36 so that a straight cut results.

After being passed through cutter device 30, packet 28 on upper angles 26 and 27 having now been separated into individual sheets, as well and sheet 18 on lower angles 20, are moved simultaneously towards the next supply station 61 by the discontinuous movement of track 14 in the direction of the arrow 19. Prior to reaching station 61, upper angles 26 and 27 terminate, so that the individual sheets from packet 28 are pushed off the ends of angles 26 and 27 which terminate at a position slightly downstream from blade 36, and onto lower angles 20, so that there is now a single pile of sheet material comprised of individual sheet 18 and the separated sheets from packet 28. Then, the next sheet 62, shown in dotted lines in FIG. 1, is dispensed from supply station 61 on top of such pile. Also shown in FIG. 1 downstream from supply station 61 is insert station 70, where the collated pile of sheet material is put into an envelope by mailing station 10 in manner known to those skilled in the art.

Figure 4:
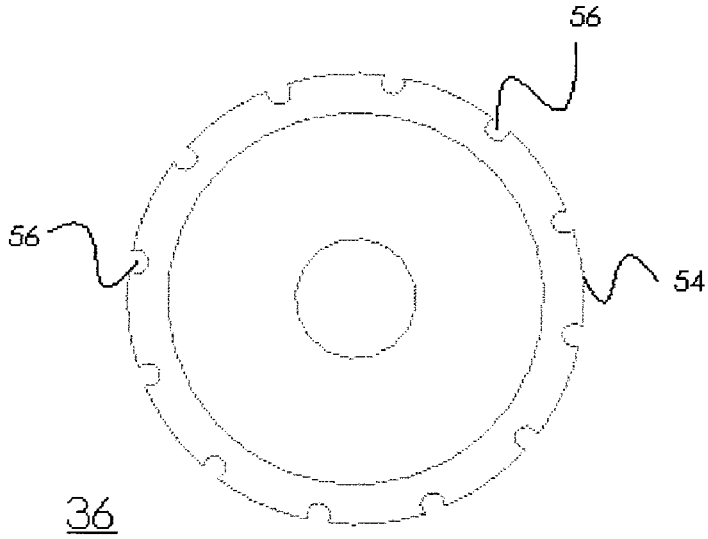
FIG. 4 illustrates cutting knife or blade used with the cutter device of the present invention.

FIG. 4 illustrates a preferred embodiment of cutting blade 36. Blade 36 is a rotary blade and is connected to motor driveshaft 38 via a central aperture 52 in a usual manner. Blade 36 has a plurality of spaced apart perforations or notches 56 on the cutting edge 54 of the blade. The cutting device 30 of the present invention does not utilize a rotating angle, as is commonly found in prior art rotary cutting arrangements, since through experimentation the present inventors found that a rotating angle interferes with the passage of individual sheets along the lower track or angle section, and thus could not be used. Nevertheless, a rotating angle and blade combination generally has heretofore been thought to provide a better or more precise cut than a single rotating blade. After a significant amount of trial and error and experimentation, the inventors have discovered that in order for the cutting device 30 to utilize a rotating blade 36 without a rotating anvil, which as just mentioned would interfere with the ability of individual sheets such as sheet 18 to pass along on the track on angles 20, improvements to the blade 36 must be made to prevent the paper from binding with the blade upon being cut. In particular, the cutting edge 54 of blade 36 is provided with a relief pattern comprised of a plurality of spaced notches 56. In a preferred embodiment, blade 26 is an outside diameter of 1⅞ inches, an inside diameter of ½ inches, a thickness of 0.025 inches. In addition, the angle of the blade is 7 degrees, which angle it has been found in combination with the particular relief pattern provides the best cutting results. The above-mentioned notches 56 are also preferably provided at an interval of every 30 degrees in cutting edge 54. Thus, there are twelve notches in the outer periphery or cutting edge of the blade. Each notch preferably measures 0.060 inches wide by 0.080 inches deep, and the notches may have a slightly rounded configuration. Provision of the notches as described above makes the paper easier to control and prevents the paper from binding with the blade upon cutting the folded edges or spine from the packets as described above. The blade thus is not to list as a wood cutting blade or the like, but rather as primarily a smooth edge, with the relief pattern being necessary to prevent binding when the spine of the folded packets is cut off. Upon being cut from the packets 28, the spines are then directed the guide 59 to a separate collection area 60 so they do not collect near the blade and possibly interfere with the cutting process. In addition, in another embodiment, in the event that the supply station arranged for use with the cutter device 30 is loaded with individual sheets rather than packets requiring this spines to be cut, the upper guide angles can either be removed so that the individual sheets are piled directly on the lower guide angles or the sheets already collected on the lower angles, and moved directly to the next supply station, rather than passing on the upper angles towards the cutter device 30. Alternatively, such collection bin could be left empty, assuming there were a sufficient number of other supply bins available to accommodate the number of sheets required in the collating process. Such arrangements would enable the mailing machine to be ready to handle larger packets, while also still operating at maximum capacity with inserts containing a fewer number of sheets.

Figure 5:
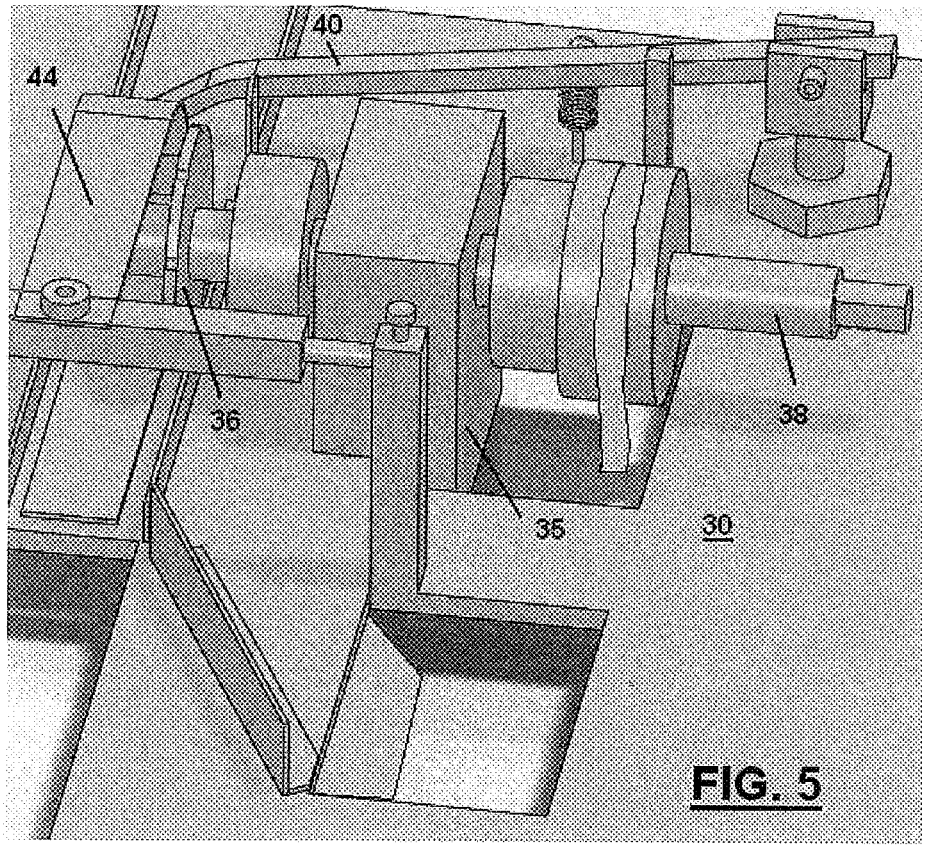
FIGS. 5-6 further illustrate the details of the cutter device of the present invention.
Figure 6:
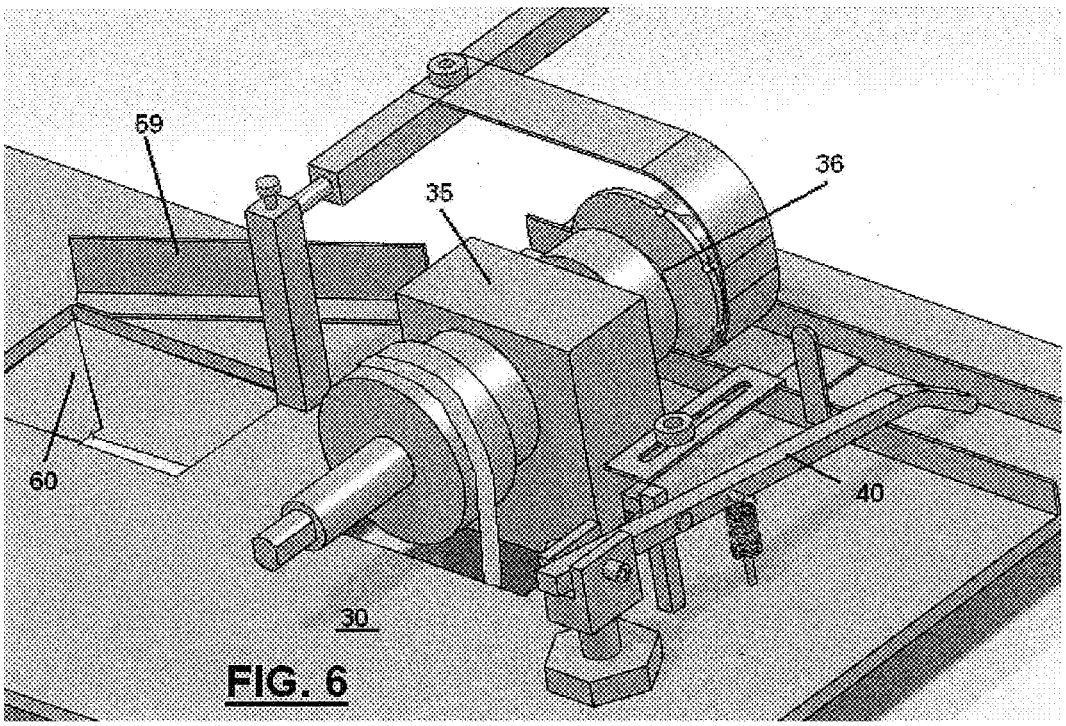

In summary, in operation, a piece of sheet material is pulled from a first supply station onto the track, with guide angles on either side of the material, which piece of sheet material gets moved down the mailing machine. The sheet material if comprised of a single sheet that does not require cutting is directed along the angles. If as in the exemplary arrangement shown in FIG. 1 the second supply station contains packets of sheet material rather than individual sheets, the sheet materials is passed underneath another set of angles at the second supply station, where packet of material is pulled and placed on the above-described top or upper angles. Both the materials on the upper and lower angles are moved down the mailing machine by the same track, one piece supported on the bottom angles and the other piece supported on the top angles, with the material pieces superimposed on each other. The material on the top angles is folded material, and typically will be comprised of several pages folded together into booklets which may consist of 8, 10, 12, or 16 pages. The folded edge or spine is supported on the front top angle, where the anvil and blade are located. The track then moves to push the folded material across the blade, and the blade then cuts the folded edge or spine (⅛" cut) off of the booklet, separating the booklet into individual pieces (8, 10, 12, or 16). Upon further movement of the track these individual pieces are then pushed off the top angles, which terminate at a position slightly downstream from blade 26, onto the material being pushed on the bottom angles. The above-described process continues, until the material reaches the "insert station" where it gets packaged into an envelope which is then sealed and ready for mailing or further processing. FIGS. 5-6 further illustrating the details and manner of use of the cutter device 30.

It is further noted that while in the cutter device 30 of the present invention has been described herein as being mounted to the front of mailing machine 10, to cut a forward facing or front spline, the cutter device 30 could also be mounted to the rear of the mailing machine and adapted to cut a rearwardly facing or rear spline. Providing the cutter device inline with the mailing machine track as opposed to redirecting either the packets out of line for cutting significantly or redirecting the individual sheets so they are not cut speeds up the mailing process and allows the mailing machine to be run at a faster cycle than would otherwise be possible. There is also less setup required to operate the cutter device as opposed to use of a chopper type blade. Furthermore, the present cutter device also saves on labor costs since it is able to handle more multiple sheet packets than prior art machines. In addition, although as illustrated in FIG. 1 mailing machine 10 includes only two sheet material supply stations, it will be understood that such illustration is only for exemplary purposes and additional supply stations would likely be provided, including if desired multiple stations containing packets of material that require the spines to be cut or removed, in which case multiple cutter devices such as provided by the present inventors would also be provided. It will also be understood that the supply stations containing individual sheets and those containing packets may be provided in a different order than is shown in FIG. 1, therefore further increasing the utility of the present invention and overcoming the limitations of the prior art.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A device for use with a collating machine having a plurality of sheet supply stations, said device for removing the spine from folded packets of sheet material picked from one of said sheet supply stations, comprising:

(a) a motor driven cutting blade;

(b) means for directing said folded packets of sheet material picked from a sheet supply station across said cutting blade to separate the spine from the packets, disassembling the packets into a plurality of individual sheets, and (c) means for combining the disassembled plurality of individual sheets with one or more associated sheets picked from another supply station either upstream or downstream from said device without any of said one or more associated sheets being directed across said cutting blade.

2. The device of claim 1 in which said means for directing said folded packets of sheet material across said cutting blade comprises an auxiliary sheet support structure positioned above a conveyor mechanism adapted to simultaneously convey both any associated sheets picked downstream and said folded packets of sheet material in the direction of movement of said conveyor mechanism such that only the folded packets of sheet material are placed on said auxiliary sheet support structure and directed across said cutting blade.

3. The device of claim 2 in which said cutting blade is comprised of a rotary cutting blade which is utilized in combination with a stationary anvil to cut the spine from said folded packets of sheet material on said auxiliary sheet support structure.

4. The device of claim 3 in which said stationary anvil includes a gradually upwardly angled surface arranged to guide the folded packets of sheet material into close proximity with said cutting blade.

5. The device of claim 4 additionally comprising a hold down bar positioned in close proximity to said stationary anvil to hold said packets closed during separation of the spine of said packets by said cutting blade.

6. The device of claim 5 in which said rotary cutting blade additionally comprises a smooth cutting surface with a cutting angle of about seven degrees, said cutting surface additionally being interrupted about every thirty degrees by a relief pattern comprising a plurality of spaced apart rounded notches having a width of about 0.060 inches and a depth of about 0.080 inches.

7. The cutter device of claim 4 additionally comprising a spring activated hold down bar which is brought downwardly into contact with the upwardly facing surface of said packets upon being placed on the auxiliary sheet support structure by a picking mechanism.

8. The device of claim 2 in which said auxiliary sheet support structure is comprised of a pair of spaced apart angles aligned with the conveyor mechanism.

9. The device of claim 8 in which said means for combining the plurality of individual sheets with said one or more associated sheets picked from other supply stations includes a mechanism associated with said conveyor mechanism for pushing said plurality of disassembled individual sheets off the end of the spaced apart angles on to any said one or more associated sheets, forming a single packet of individual sheets.

* * * * *